US009863696B2

(12) United States Patent
Chong et al.

(10) Patent No.: US 9,863,696 B2
(45) Date of Patent: Jan. 9, 2018

(54) SYSTEM AND PROCESS FOR NATURAL GAS LIQUEFACTION

(75) Inventors: Wen Sin Chong, Singapore (SG); Xiaoxia Sheng, Singapore (SG); Ravindu Atapattu, Singapore (SG); Kok Seng Foo, Singapore (SG)

(73) Assignee: KEPPEL OFFSHORE & MARINE TECHNOLOGY CENTRE PTE LTD, Singapore (SG)

( * ) Notice: Subject to any disclaimer, the term of this patent is extended or adjusted under 35 U.S.C. 154(b) by 0 days.

(21) Appl. No.: 14/359,544

(22) PCT Filed: Jun. 6, 2012

(86) PCT No.: PCT/SG2012/000206

§ 371 (c)(1),
(2), (4) Date: May 20, 2014

(87) PCT Pub. No.: WO2013/184068

PCT Pub. Date: Dec. 12, 2013

(65) Prior Publication Data

US 2014/0305160 A1 Oct. 16, 2014

(51) Int. Cl.

| | |
|---|---|
| ***F25J 1/00*** | (2006.01) |
| ***F25J 1/02*** | (2006.01) |
| *C10L 3/10* | (2006.01) |

(52) U.S. Cl.

CPC ..... *F25J 1/0022* (2013.01); *F25J 1/004* (2013.01); *F25J 1/005* (2013.01); *F25J 1/0052* (2013.01);

(Continued)

(58) Field of Classification Search

CPC ..... F25J 1/0305; F25J 1/0204; F25J 1/0032; F25J 1/0212; F25J 1/0203; F25J 1/0207;

(Continued)

(56) References Cited

U.S. PATENT DOCUMENTS

| | | | | |
|---|---|---|---|---|
| 5,768,912 | A * | 6/1998 | Dubar | F25J 1/0022 62/613 |
| 5,826,444 | A | 10/1998 | Capron et al. | |
| 5,916,260 | A * | 6/1999 | Dubar | 62/613 |
| 6,041,619 | A | 3/2000 | Fischer et al. | |
| 2003/0089125 | A1 * | 5/2003 | Fredheim | F25J 1/0022 62/612 |
| 2004/0148962 | A1 * | 8/2004 | Rashad et al. | 62/606 |
| 2005/0247078 | A1 * | 11/2005 | Wilkinson et al. | 62/612 |
| 2009/0113928 | A1 * | 5/2009 | Vandor | F25J 1/0022 62/612 |
| 2009/0217701 | A1 * | 9/2009 | Minta et al. | 62/612 |

(Continued)

FOREIGN PATENT DOCUMENTS

CN 101948706 A 1/2011

OTHER PUBLICATIONS

Safety Data Sheet R23, Revision Date Aug. 15, 2013, Version 1.0, pp. 4-5.*

(Continued)

*Primary Examiner* — Frantz Jules
*Assistant Examiner* — Brian King
(74) *Attorney, Agent, or Firm* — John P. White; Cooper & Dunham LLP

(57) ABSTRACT

Embodiments of the present invention provide a process for liquefaction of a natural gas. The process includes cooling the natural gas with a first refrigerant provided by a first cooling system and cooling the natural gas with a second refrigerant provided by a second cooling system. The second cooling system is a single phase cooling system. The first and second cooling systems operate independently from each other. The second refrigerant is cooled with the first refrigerant so that the cooling capacity of the second refrigerant and the second cooling system is increased.

7 Claims, 5 Drawing Sheets

(52) U.S. Cl.
CPC ..... *F25J 1/0072* (2013.01); *F25J 1/0097* (2013.01); *F25J 1/0204* (2013.01); *F25J 1/0205* (2013.01); *F25J 1/0212* (2013.01); *F25J 1/0215* (2013.01); *F25J 1/0227* (2013.01); *F25J 1/0242* (2013.01); *F25J 1/0268* (2013.01); *F25J 1/0278* (2013.01); *F25J 1/0283* (2013.01); *F25J 1/0288* (2013.01); *F25J 1/0292* (2013.01); *F25J 1/0296* (2013.01); *C10L 3/102* (2013.01); *F25J 2220/64* (2013.01); *F25J 2240/82* (2013.01); *F25J 2245/90* (2013.01); *F25J 2270/906* (2013.01)

(58) Field of Classification Search
CPC ..... F25J 1/0208; F25J 1/0209; F25J 1/0225; F25J 1/0227; F25J 1/0022; F25J 1/005; F25J 1/02122
USPC ..... 62/611, 613
See application file for complete search history.

(56) References Cited

U.S. PATENT DOCUMENTS

| | | | | |
|---|---|---|---|---|
| 2010/0126214 | A1* | 5/2010 | Paradowski ..... | F25J 1/0022 62/612 |
| 2010/0147024 | A1* | 6/2010 | Roberts ..... | F25J 1/0022 62/612 |
| 2010/0281915 | A1* | 11/2010 | Roberts et al. ..... | 62/612 |

OTHER PUBLICATIONS

Notification of Transmittal of the International Search Report and the Written Opinion of the International Searching Authority, or the Declaration, including an International Search Report and Written Opinion of the International Searching Authority, dated Aug. 30, 2012 in connection with PCT International Application No. PCT/SG2012/000206, filed Jun. 6, 2012.

* cited by examiner

100
Feed Gas
1
2
AGRU
4
Dehydration
5
Hg Removal
6
7
Ref
9
10
Ref
11
12
13
14
15
CW
16
Condensate
Water
3
Refrigeration Package
8
102
Gas Turbine
24
25
26
27
CW
28
CW
29
30
CW
31
32
Ref
R
17
18
19
20
LNG
21
M
22
CW
23
Fuel Gas Feed Gas
1
2
AGRU
4
Dehydration
5
Hg Removal
6
7
Ref
9
10
Ref
11
12
13
14
15
CW
16
Condensate
Water
3
8'
Ammonia Absorption Cooling System
102
Gas Turbine
24
25
26
27
CW
28
CW
29
30
CW
31
32
Ref
17
18
19
20
LNG
21
M
22
CW
23
Fuel Gas

SYSTEM AND PROCESS FOR NATURAL GAS LIQUEFACTION

TECHNICAL FIELD

The present invention relates to a system and process for natural gas liquefaction. In particular, the present invention relates to an offshore system and process for natural gas liquefaction.

BACKGROUND

Liquefied natural gas (LNG) can be produced in both the on-shore environment and the offshore environment. Compared to on-shore environment, offshore production of LNG faces many restrictions under which, the LNG productivity is limited. One of these restrictions is due to the size and capacity of Refrigerant Compressor driver (typically gas turbine) used in expander-based LNG process.

In present offshore LNG production, the common selection of gas turbine is one supplied by GE, Rolls-Royce, Siemens, Man, etc., in which, LM6000 is the biggest gas turbine for offshore LNG plant. The maximum LNG production rate per train if such type of gas turbine is up to 1.2 MTPA, using dual nitrogen ($N_2$) expander cycle.

SUMMARY OF THIS INVENTION

The present invention provides an LNG production system and method capable of achieving an increased LNG production rate without increasing the Refrigerant Compressor driver size and capacity.

The aim of this present invention is to provide a modified nitrogen expander cycle based LNG process, with an improved LNG production rate, which is limited by the size of the driver for main refrigerant compressor, typically Gas turbine for offshore. In the mean time, the LNG liquefaction efficiency is also improved. With the addition of an independently-operated chiller into the nitrogen expander cycle after the gas turbine driven compressor or expander driven compressor, the LNG production rate can be increased without increasing the driver size and capacity.

In one aspect, embodiments of the present invention provide a process for liquefaction of a natural gas. The process includes cooling the natural gas with a first refrigerant provided by a first cooling system and cooling the natural gas with a second refrigerant provided by a second cooling system. The second cooling system is a single phase cooling system. The first and second cooling systems operate independently from each other. The second refrigerant is cooled with the first refrigerant such that the cooling capacity of the second refrigerant and the second cooling system is increased.

In another aspect, embodiments of the present invention provide a system for liquefaction of a natural gas. The system includes a first cooling system for cooling the natural gas with a first refrigerant, and a second cooling system for cooling the natural gas with a second refrigerant. The second cooling system is a single phase cooling system. The first and second cooling systems operate independently from each other. The first cooling system includes a first cooling device coupled to the second cooling system for cooling the second refrigerant.

BRIEF DESCRIPTION OF THE DRAWINGS

Embodiments of the invention are disclosed hereinafter with reference to the drawings, in which.

DETAILED DESCRIPTION

Figure 1:
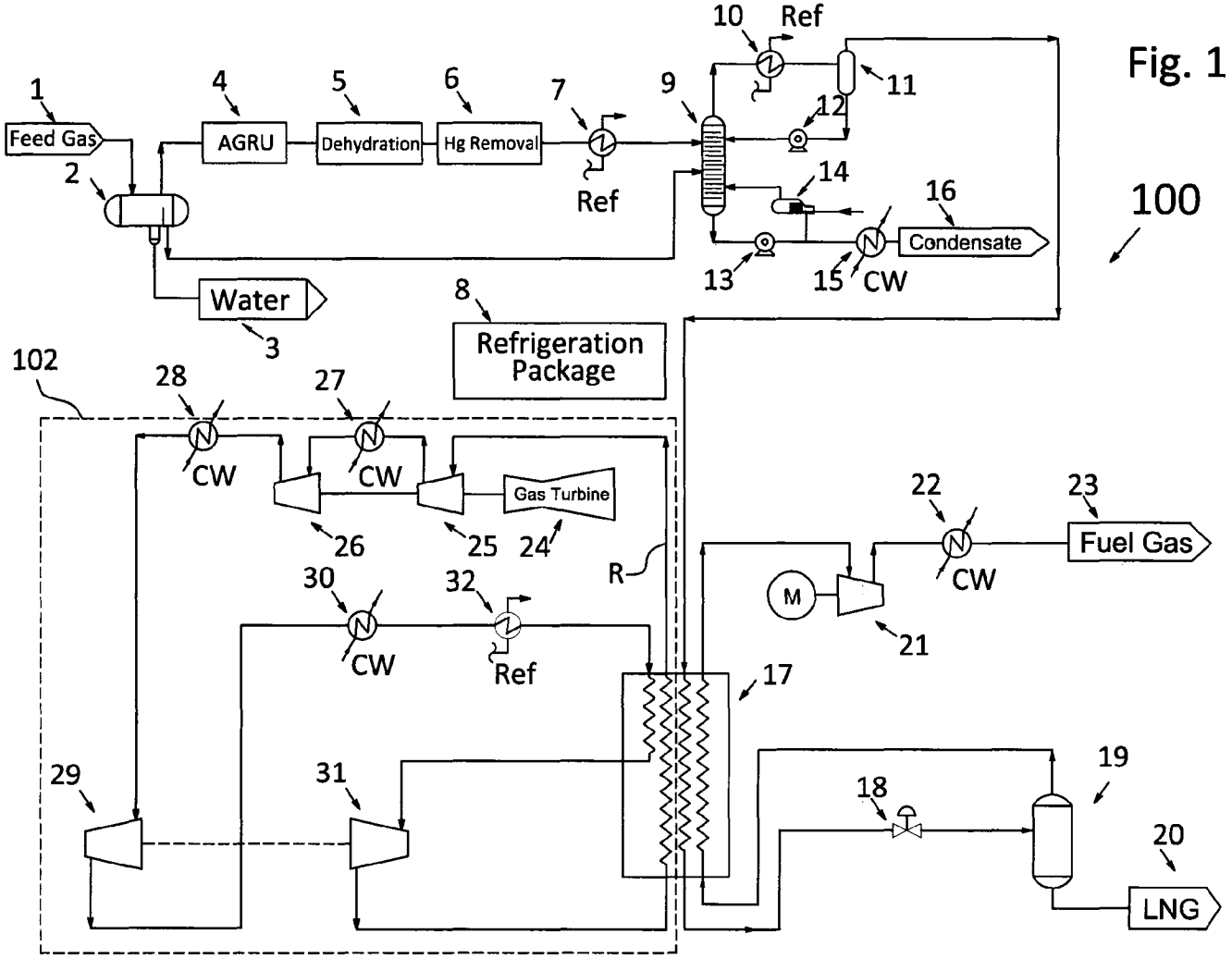
FIG. 1 is a schematic drawing showing an LNG production system and process according to one embodiment of the present invention.

FIG. 1 shows a natural gas liquefaction system and process 100 according to one embodiment of the present invention. Natural gas 1 flows into the liquefaction process from the offshore production facility. This natural gas is typically stranded gas or associated gas, and has undergone various degrees of treatment. The present description will address the case when the feed gas from a crude stabilization unit is at a pressure in the range of about 20 bar to about 60 bar, or has been compressed to a pressure in the range of about 20 bar to about 60 bar in oil production gas compressors. The offshore feed gas normally contains methane in the range of from about 70% to about 90%; ethane of about 6-10%, with typical pressure of 20-60 bar.

The feed natural gas 1 firstly enters a feed gas receiver 2 which may be a three phase separator, if a liquid water phase is present in feed natural gas 1. The vapour from the gas receiver 2 is processed with gas treatment such as acid gas removal (block 4), dehydration (block 5), and mercury (Hg) removal (block 6). The Acid Gas Removal Unit (AGRU) used at block 4 is typically an amine package that removes $CO_2$ and sulphur species to levels acceptable in the liquefaction process. Feed gas entering AGRU 4 is at an appropriate temperature for reasonable amine absorption reactivity and to ensure that no free hydrocarbon liquids can drop out in the contactor leading to amine foaming problems. A typical specification of the gas sweetening is to reach $CO_2$ at a level of less than 50 ppm.

The feed gas is typically dehydrated to a concentration of less than 1 ppm(v) of water, such that water is not deposited as solids in the downstream cold process equipment. The dehydration process shown at block 5 typically uses a molecular sieve zeolite to dry the feed gas in a temperature or pressure swing adsorption cyclical process. The regeneration gas for the process is taken from the fuel gas stream 23 because this is a "bone dry" and relatively lean stream.

Hg removal is required to avoid the potential of mercury attack on aluminium plate fin of heat exchangers and is typically carried out in a fixed adsorption bed containing either sulphur impregnated carbon or increasingly a Zn/Cu sulphide. The general requirement of Hg removal is to reach Hg level of less than 10 ng/$Sm_3$.

After Hg removal, the treated gas is cooled and partially condensed in a feed gas chiller 7, by a first biphasic refrigerant, to a temperature of approximately −20 to −40° C. The first biphasic refrigerant for the chiller 7 can be a non-flammable, non-toxic refrigerant operating in a vapour compression cycle provided by a first cooling system e.g. a refrigeration system 8. This refrigerant may be of a commercially available type, with a track record in offshore installations such as R134a. Alternative refrigerants such as R507, R410A may be used if lower temperatures are required. Because this stream may be subject to free liquids, the hydrate formation temperature for the stream should be avoided.

After cooled by chiller 7, the partially condensed feed gas enters a scrub column 9. The purpose of scrub column 9 is to remove any heavy hydrocarbon components that could form waxes or freeze as the natural gas is cooled and condensed in the liquefaction equipment. An overhead stream from scrub column 9 is cooled and partially condensed in a scrub column overhead condenser 10 against another refrigerant stream from the closed loop refrigeration system 8. Operation at a temperature in the range of from about −20° C. to about −50° C. is considered and allows sufficient recovery of heavy hydrocarbons to avoid deposition in downstream equipment and operating within acceptable margins with regard to hydrate formation. The vapour and liquid phases leaving overhead condenser 10 are separated in a scrub column reflux drum 11.

A bottoms specification at scrub column 9, typically based on vapour pressure of the scrub column, is maintained using a scrub column reboiler 14 against a warm heating media stream. The heating media is typically hot water, steam, or hot oil with a general preference towards hot water systems in the offshore environment. The stabilised condensate bottom product 16 can be returned to the oil production facility to be blended with the crude product via condensate export pump(s) 13 or stored separately. The general preference to return condensate to the crude production facility is reflective of the objective to minimise hydrocarbon inventory, operation, and exportation complexity associated with storage and export of an additional product.

The cooled gas from scrub column reflux drum 11 is further cooled and condensed in a third cooling system, e.g. a main cryogenic heat exchanger (MCHE) 17 against a gaseous refrigerant provided by a second cooling system, e.g. a reduced pressure N2 refrigerant operating in a compressor loaded expander cycle 102 and against flash gas streams, prior to flashing across an expansion device 18 into an LNG flash drum 19. In one embodiment, the expansion device 18 is of a cage guided type, for example a J-T valve, a liquid turbine followed by an expansion valve, a dense phase turboexpander, or a flashing expander.

The fluid leaving expansion device 18 will be reduced in temperature and become biphasic, comprising a vapour portion and a liquid stream. The vapour portion is referred to as flash gas, which is preferentially enriched in more volatile components such as methane and nitrogen. The liquid stream is referred to as LNG. The vapour molar fraction will typically be at least sufficient to meet the fuel gas demands of the system but not more than about 25% on a molar basis with the optimal value being determined on a project specific basis. The vapour fraction is typically at a temperature in the range of from about −163° C. to about −140° C. and is returned as a cold stream to the MCHE 17. MCHE 17 cools and condenses the incoming feed gas and provides cooling at the lowest temperatures in the liquefaction system. In some cases, it may be advantageous to mix the vapour fraction from the LNG flash drum 19 with a cold vapour stream (boil off gas or BOG) from LNG storage to recover the cold from this stream and improve the efficiency of the process. The warm flash gas after cold recovery from the MCHE 17 is further compressed, and used as one portion of the regeneration gas for the molecular sieve columns (block 5) before sent to the gas turbine to use as fuel gas.

The majority of the refrigeration required by the process is provided by closed loop, compressor-loaded expander cycle 102 which, in the present embodiment, is a single phase cooling system, e.g. a wholly or primarily gaseous turboexpand-based system, using turboexpander for a gas-phase refrigerant, which provides a cryogenic temperature in the range of −140° C. to −165° C. This cycle starts with the warm, lower pressure stream R which consists primarily of a gaseous refrigerant, e.g. an N2 refrigerant at a pressure in the range of about 8 bar to about 15 bar. In some cases, the gaseous refrigerant may include some natural gas to enhance the performance of the process or may include some other components that typically make-up air.

The low pressure refrigerant is compressed in a first compressor 25 which is driver by a gas turbine 24, to a pressure in the range of about 40 bar to about 60 bar. Two stages of compression may be used, e.g. by first compressor 25 and a second compressor 26 connected together in series. Additional compressor stages may be used. Each stage compressor 25, 26 has an aftercooler 27, 28, respectively, using either water cooler or aircooler to a temperature of 30-50° C. The high pressure N2 refrigerant is further compressed to 80-100 bar by a third compressor 29 which is driven by an expander 31, with a typical pressure ratio of 1.5 generating the highest pressure in the closed loop at the outlet of the compressor. The high pressure refrigerant leaving third compressor 29 is chilled in recompressor aftercooler 30, followed by another chiller 32 to a temperature of −20° C. to −50° C. before it enters and cooled in MCHE 17 to a temperature of −40° C. to −80° C.

Chiller 32 forms part of, and uses the first biphasic refrigerant supplied by, refrigerant system 8. Since refrigerant system 8 operates independently from gas turbine 24, chiller 32 is capable of providing additional cooling capacity to further reduce the temperature of N2 refrigerant from aftercooler 30, without the need to increase the size and capacity of gas turbine 24. In situations where selection of gas turbine is limited by industry-available size and capacity, the present embodiment can achieve increased LNG production rate beyond the capacity limit of a given gas turbine.

The chilled refrigerant leaves the MCHE 17 and is expanded in the turboexpander 31 to a low pressure of 8-15 bar with a temperature range of −120° C. to −150° C. This expansion is completed in turboexpander 31 to effect a primarily isentropic expansion and a resultant large decrease in temperature. An efficient expansion process greatly enhances the efficiency of the LNG production.

The low pressure refrigerant at the outlet of the turboexpander 31 is returned as a cold stream to the MCHE 17 and used to provide main cooling for the liquefaction of natural gas. This gas is at a temperature considerably colder than the cooled HPN refrigerant but warmer than the flash gas coming from the LNG flash drum 19 such that it opens the cooling curves in the MCHE 17 at warmer and intermediate temperatures. This gas is warmed against the warm feed natural gas and high pressure refrigerant stream, prior to recompression in the $N_2$ refrigerant compressor 25/26 to complete the cycle.

Figure 2:
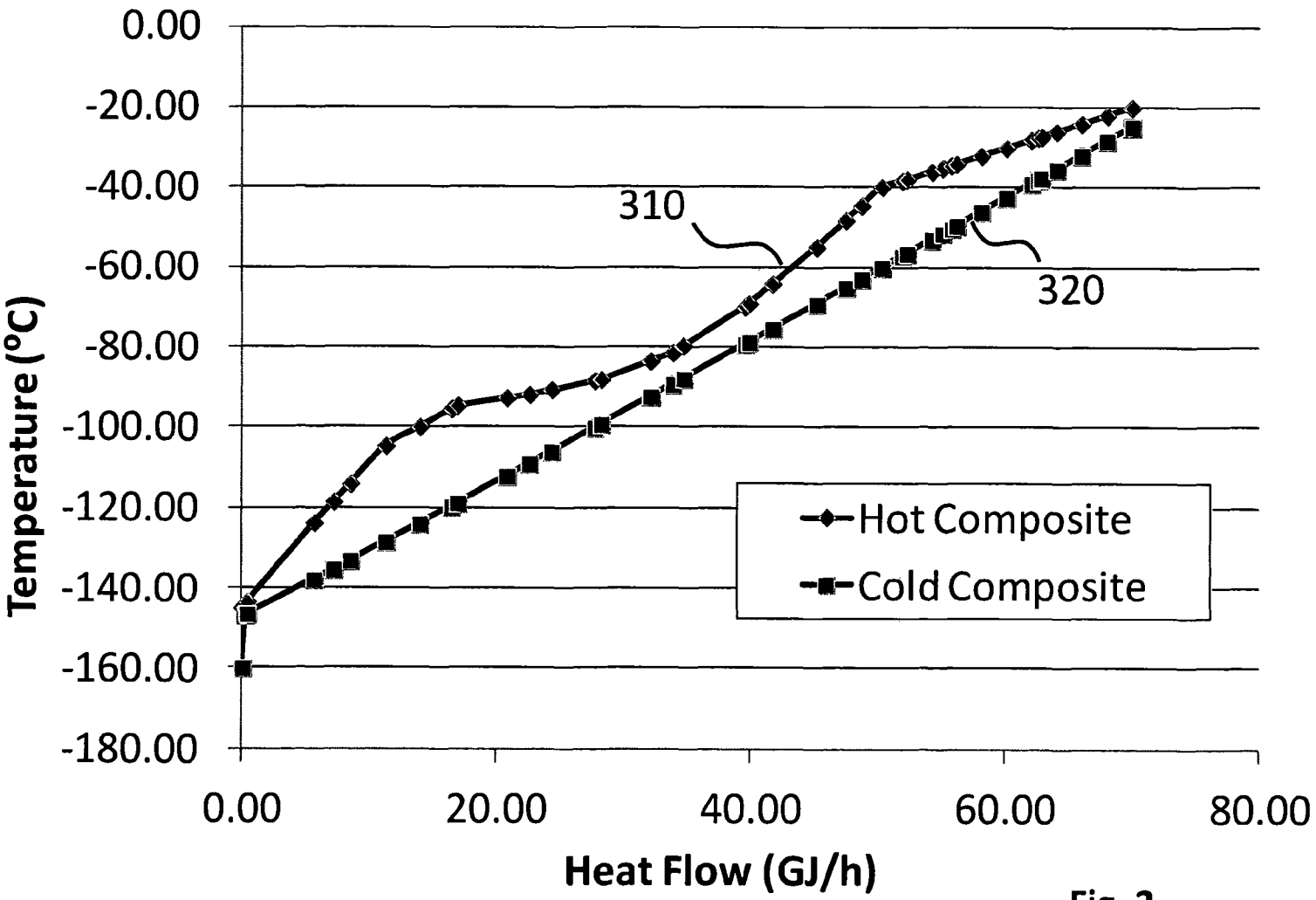
FIG. 2 shows Heat Flow-Temperature curves of an LNG production system and process according to one embodiment of the present invention.

FIG. 2 shows a typical cooling curve of the above described process in FIG. 1. The upper curve 310 represents the cooling of the natural gas stream. The lower curve 320 represents the consolidated heating curve for the refrigerant streams of the present invention. The close fit of the warm stream and cold stream indicates the high liquefaction efficiency of this associated gas liquefaction process.

TABLE 1

| Case No. | Description | Compressor Power (MW) N2 | R134A | Total | LNG production (ton/hr) | (MTPA) | liquefaction Specific power (kWh/kg) |
|---|---|---|---|---|---|---|---|
| Case 1 (conventional process) | R134A to precool NG only (no chiller in N2 loop) | 30. | 1.16 | 31.16 | 58.7 | 0.51 | 0.53 |
| Case 2 (FIG. 1) | R134A to precool NG + N2 both (add chiller 32) | 30. | 6.86 | 36.86 | 75.3 | 0.65 | 0.48 |
| Case 3 | R134A to precool NG + N2 + recompressor (add chiller 32 + 33) | 30. | 12.84 | 42.86 | 82.0 | 0.71 | 0.52 |
| Case 4 (FIG. 3) | R134A to precool NG + N2 + recompressor + 2nd stage compressor (add chiller 32 + 33 + 34) | 30. | 19.1 | 49.17 | 87.4 | 0.76 | 0.56 |
| Case 5 (FIG. 4) | R134A to precool NG + N2 + recompressor + 2nd stage compressor (chiller 32 using the cold duty from Ammonia Gas Absorption System using waste Heat from GT) | 30. | 0 | 30 | 75.3 | 0.651 | 0.40 |

Figure 3:
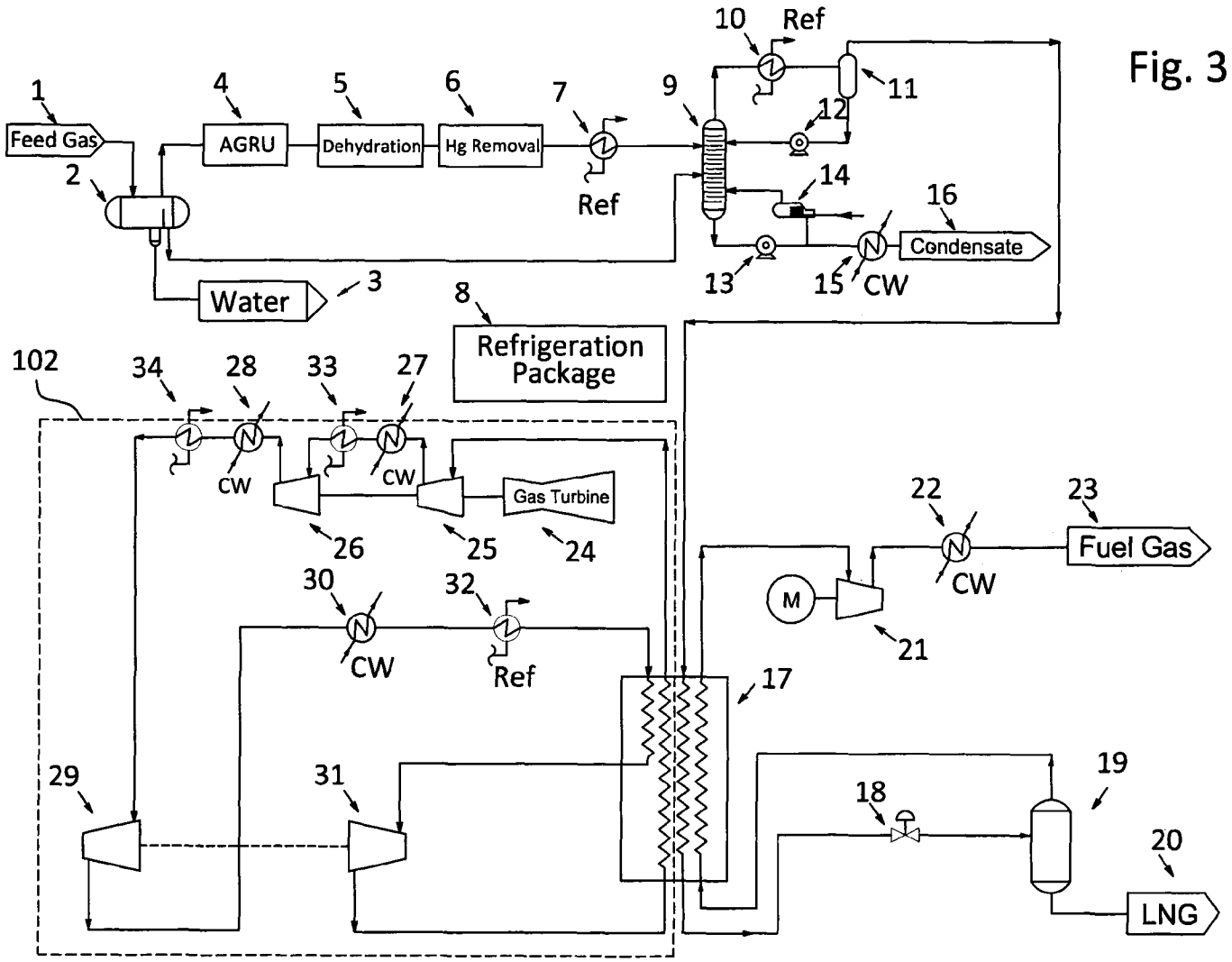
FIG. 3 is a schematic drawing showing an LNG production system and process according to another embodiment of the present invention.

In another embodiment, as shown in FIG. 3, additional chillers 33 and 34 are added into cooling cycle 102, downstream of each gas turbine driven compressor aftercoolers 27 and 28, respectively. Similar to the configuration of chiller 32, chillers 33 and 34 form part of, and uses the first biphasic refrigerant supplied by, refrigerant system 8. Since refrigerant system 8 operates independently from gas turbine 24, chillers 33 and 34 are capable of providing additional cooling capacity to further reduce the temperature of N2 refrigerant from respective aftercoolers 27/28, without the need to increase the size and capacity of gas turbine 24. In situations where selection of gas turbine is limited by industry-available size and capacity, the present embodiment can achieve further increased LNG production rate beyond the capacity limit of a given gas turbine.

Table 1 shows the comparison of LNG production rate achieved by various embodiments of the present invention and a conventional system (case 1), under the same duty/capacity of gas turbine driven compressor. In a system and process with using chiller 32 illustrated in FIG. 1 (Case 2), the LNG production rate is increased by 28% from 0.51 MTPA to 0.65 MTPA, with 8% overall liquefaction efficiency improvement by reducing the specific power from 0.53 to 0.49 kW/(kg/h LNG).

In a system and process using additional chillers 33 and 34 (FIG. 3), the LNG production rate is further increased by 17%, from 0.65 to 0.76 MTPA. Meanwhile, the performance of expander driven compressor 29 is also improved in term of its compression pressure ratio increase, hence the N2 compressor discharge pressure requirement is reduced after the last stage of gas turbine driven compressor 26.

The first cooling system can be a mechanical vapour compression cooling system, a gas absorption refrigeration system, or a gas adsorption cooling system, which provides the intermediate cooling temperature in the range of −50° C. to 0° C.

Figure 4:
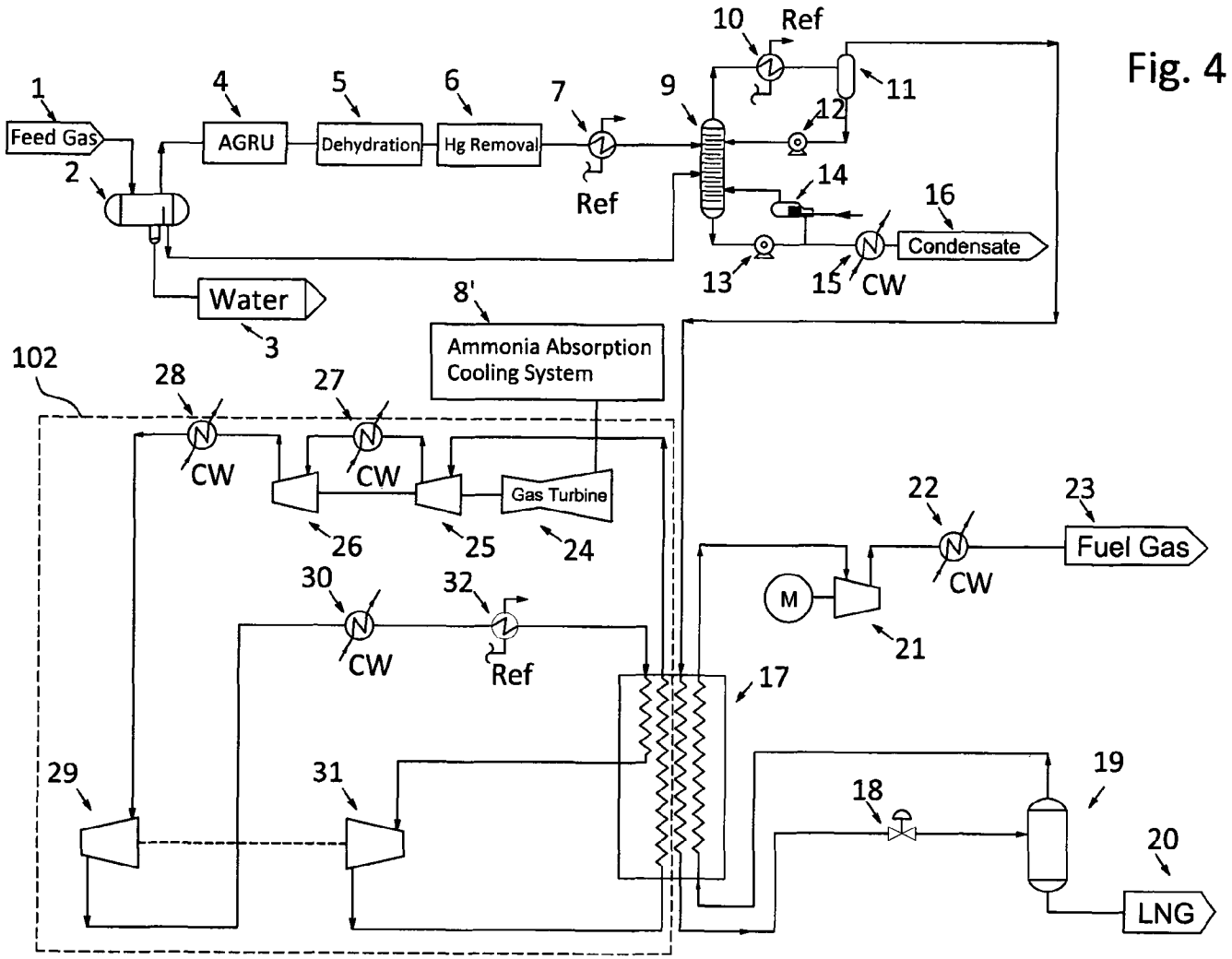
FIG. 4 is a schematic drawing showing an LNG production system and process according to yet another embodiment of the present invention.

According to yet another embodiment, as shown in FIG. 4, first cooling system 8' may be of a type using gas-absorption refrigeration. The waste heat generated by Gas turbine 24 is used to provide cooling duty for the chillers in first cooling system 8'For example, an ammonia absorption refrigeration cycle recovering the waste heat from the gas turbine of N2 refrigerant, as shown in FIG. 4, can provide the cooling duty for the chillers 7, 30, and 32. Hence, the overall plant power consumption is reduced, and the liquefaction specific power can be improved, e.g. by 20% from 0.48 to 0.40 kWh/kg.

Figure 5:
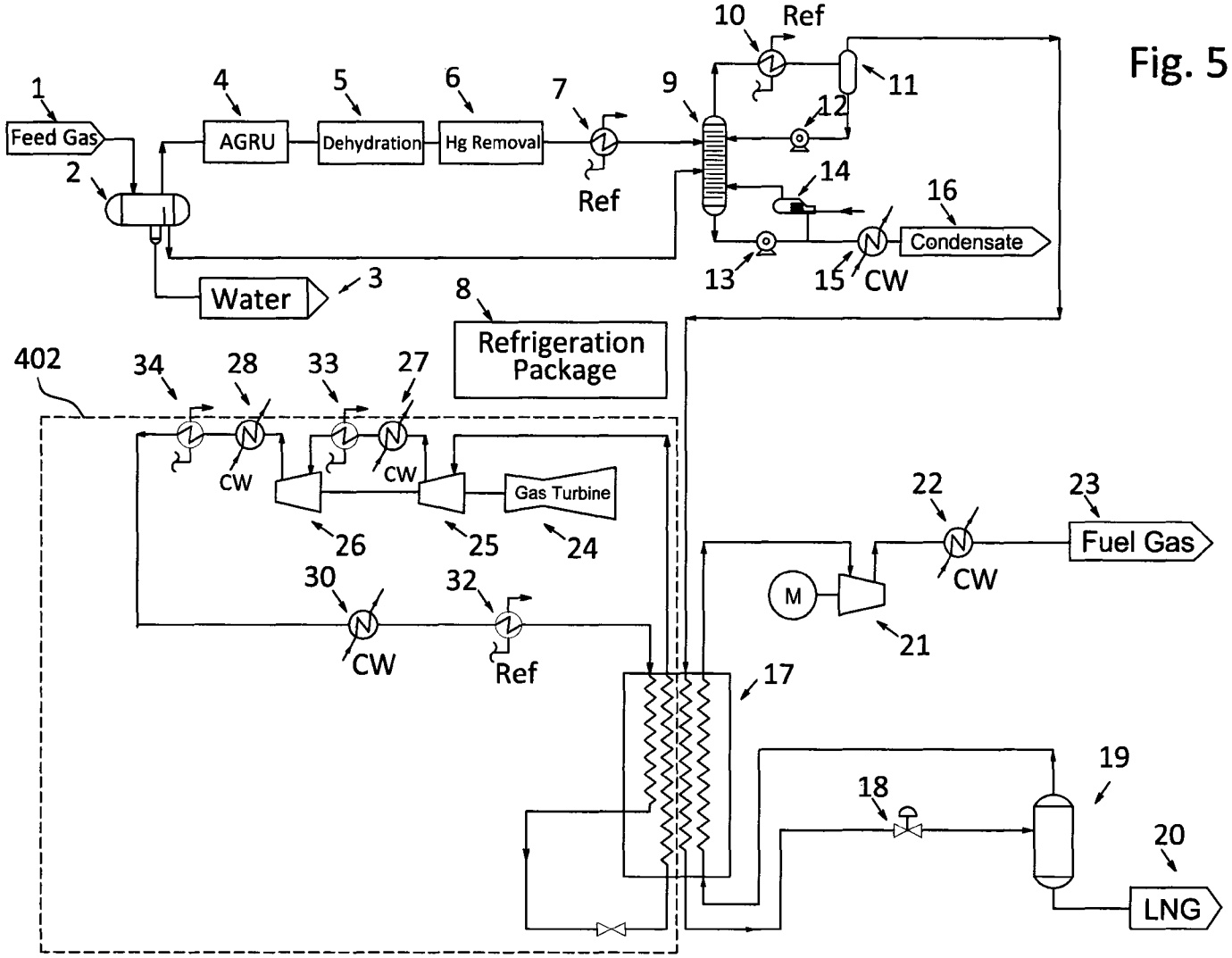
FIG. 5 is a schematic drawing showing an LNG production system and process according to a further embodiment of the present invention.

In a further embodiment as shown in FIG. 5, a natural gas liquefaction system and process 500 includes a first cooling system 8 and a second cooling system 402. In the present embodiment, second cooling system 402 is a mixed refrigerant system. A portion of the first refrigerant supplied by first cooling system 8 is used for cooling the suction stream of the mixed refrigerant in second cooling system 402, which provides the main cold for the liquefaction of natural gas, to increase the overall LNG production rate. Second cooling system 402 includes a first compressor 25 and a first aftercooler 27. First refrigerant from first cooling system 8 is introduced to second cooling system 402 at chiller 33 which is downstream of first aftercooler 27. Further compressor 26 and aftercooler 28 may be used downstream of chiller 33 in second cooling system 402. In this case, a further chiller 34 using first refrigerant supplied by first cooling system 8 is placed downstream of aftercooler 28 to provide additional cooling effect to second cooling system 402.

The invention claimed is:

1. A system for liquefaction of a natural gas, the system comprising:

(a) a first cooling system for cooling the natural gas with a biphasic, non-flammable and non-toxic refrigerant, the cooled natural gas passing from the first cooling system to a scrub column system for further processing; and (b) a second cooling system comprising a cryogenic heat exchanger having a first inlet which is directly connected to an outlet of the scrub column system to receive the further processed, cooled natural gas output by the scrub column system, the second cooling system further cooling the further processed natural gas cooled by the first cooling system with a single-phase refrigerant, the further cooled natural gas, further cooled in the cryogenic heat exchanger, passing to a first outlet of the cryogenic heat exchanger, wherein;

a first cooling device that includes an outlet directly connected to a second inlet of the cryogenic heat exchanger and that is coupled to the first cooling system and the second cooling system, the first cooling device cooling the single-phase refrigerant using the biphasic, non-flammable and non-toxic refrigerant supplied by the first cooling system;

wherein the second cooling system further comprises:

at least one compressor to receive, via an inlet of the at least one compressor, the single-phase refrigerant from a second outlet of the cryogenic heat exchanger and to compress the single-phase refrigerant; and a gas turbine for driving the at least one compressor, wherein the first cooling device is positioned upstream from the cryogenic heat exchanger and pre-cools the single-phase refrigerant prior to the entry of the single-phase refrigerant into the second inlet of the cryogenic heat exchanger via the outlet of the first cooling device.

2. The system of claim 1, wherein the at least one compressor of the second cooling system includes a first compressor, a second compressor, and an expander-driven compressor, wherein the first cooling device is positioned downstream of the expander-driven compressor for cooling the single-phase refrigerant.

3. The system of claim 2, wherein the second cooling system further includes a second cooling device coupled to the second cooling system between the first compressor and the second compressor for cooling the single-phase refrigerant.

4. The system of claim 3, wherein the second cooling system further includes a third cooling device coupled to the second cooling system between the second compressor and the expander-driven compressor for cooling the single-phase refrigerant.

5. The system of claim 1, wherein the first cooling system is selected from one of a mechanical vapour compression cooling system, a gas absorption refrigeration system, and a gas adsorption cooling system, wherein the first cooling system is to provide an intermediate cooling temperature in the range of −50° C. to 0° C.

6. The system of claim 1, wherein the at least one compressor of the second cooling system includes a first and a second stage compressor driven by one of a gas turbine and an electrical motor.

7. The system of claim 1, wherein the second cooling system further includes a turboexpander positioned downstream from the cryogenic heat exchanger for cooling the single-phase refrigerant and returning the single-phase refrigerant to the cryogenic heat exchanger, to provide a cryogenic temperature in the range of −140° C. to −165° C.

* * * * *